US005188771A

United States Patent [19]

De Witt

[11] Patent Number: 5,188,771

[45] Date of Patent: Feb. 23, 1993

[54] METHOD AND APPARATUS FOR TREATING A GAS OR LIQUID

[75] Inventor: James J. De Witt, Johannesburg, South Africa

[73] Assignee: Aquafan (Proprietary) Limited, Johannesburg, South Africa

[21] Appl. No.: 620,546

[22] Filed: Nov. 29, 1990

[30] Foreign Application Priority Data

Nov. 30, 1989 [ZA] South Africa ..... 89/9138

[51] Int. Cl.[5] ..... B01F 3/04; B01F 5/20

[52] U.S. Cl. ..... 261/25; 261/91

[58] Field of Search ..... 261/25, 91, 88

[56] References Cited

U.S. PATENT DOCUMENTS

| | | | |
|---|---|---|---|
| 901,450 | 10/1908 | Keller | 261/88 |
| 1,060,936 | 5/1913 | Petermoller . | |
| 1,072,031 | 9/1913 | Rankine et al. | 261/91 |
| 1,190,386 | 7/1916 | Dickerson . | |
| 1,246,109 | 11/1917 | Kieser . | |
| 1,513,320 | 10/1924 | Horn . | |
| 1,656,591 | 1/1928 | McGurty . | |
| 1,685,221 | 9/1928 | Bahnson . | |
| 1,766,643 | 6/1930 | Janes | 261/91 |
| 1,894,864 | 1/1933 | Hall | 261/91 |
| 1,952,269 | 3/1934 | Lundquist | 261/91 |
| 1,978,007 | 10/1934 | Anthony, Jr. . | |
| 1,993,299 | 3/1935 | Prott | 261/91 |
| 2,053,647 | 9/1936 | White . | |
| 2,296,930 | 9/1942 | Ihler | 261/91 |
| 2,473,035 | 6/1949 | Meade et al. | 261/88 |
| 2,631,833 | 3/1953 | De Vilbiss | 261/91 |
| 2,633,290 | 3/1953 | Schaefer et al. | 230/108 |
| 2,911,137 | 11/1959 | Edwards | 230/108 |
| 3,128,320 | 4/1964 | Umbricht | 261/29 |
| 3,130,245 | 4/1964 | Banks | 261/91 |
| 3,391,858 | 7/1968 | De Lancey | 230/108 |
| 3,640,464 | 2/1972 | Malczewski | 261/91 |
| 3,827,071 | 8/1974 | Valbona et al. | 261/91 |

FOREIGN PATENT DOCUMENTS

| | | | |
|---|---|---|---|
| 492642 | 3/1919 | France | 261/25 |
| 990353 | 6/1951 | France | 261/91 |
| 1222452 | 1/1960 | France | 261/88 |
| 254130 | 7/1926 | United Kingdom | 261/91 |

*Primary Examiner*—Tim Miles
*Attorney, Agent, or Firm*—Darby & Darby

[57] ABSTRACT

The method and apparatus for treating a gas and a liquid, typically in water, comprises discharging the water radially outwardly from a rotating head and using the water movement to draw air into an intake to be scrubbed, humidified and cooled by the water, before exiting.

5 Claims, 2 Drawing Sheets

METHOD AND APPARATUS FOR TREATING A GAS OR LIQUID

INTRODUCTION

This invention relates to a method and an apparatus for treating a gas or a liquid.

BACKGROUND TO THE INVENTION

Fluid used in large scale air conditioning and related applications, typically a liquid and gas mixture of water and air, is often treated or scrubbed to clean it. This treatment can include filtering, humidifying and cooling the fluid.

One system for such treatment of air in mine ventilation, directs a spray of chilled water at rotating fan blades, which blades drive the air for use in ventilation. The water impacts the blades and cools the air by contact. The system requires sophisticated waterproofing of the fan drive and also results in rapid wear of the blades.

The use of a thrown fluid movement for pumping fluid is known, and one example is described in U.S. Pat. No. 2,911,137 to M. L. Edwards. Edwards utilises a rotary impeller in a primed sump to draw fluid through a hollow shaft, and discharge it radially to drive the fluid. The pumping fluid and the driven fluid are usually not the same and the essence of the pumping action is that the fluids mix at low relative velocities and pumping energy.

Another kind of impeller is known in use with a vacuum pump, and is described in U.S. Pat. No. 2,633,290 to Schaefer. et al. In the Schaefer device, a pair of rotating spiral tubes within a vessel are used to draw water from a sump at the vessel bottom, and throw the water radially outwardly at the vessel top, to draw air out of the vessel and create a vacuum therein.

OBJECT OF THE INVENTION

It is an object of this invention to provide a method and apparatus for treating a gas and a liquid.

SUMMARY OF THE INVENTION

In accordance with this invention, there is provided a method of treating a gas or a liquid comprising introducing a liquid into a rotating head having a liquid outlet means around it, rotating the head in a housing to discharge the liquid generally radially outwardly from the head towards the housing wall, and to be partially dispersed, and, introducing a gas into the housing to be driven by movement of the discharged liquid and be in contact with the dispersed and discharged liquid, to thereby cause at least one of the liquid or gas to be treated, the gas being driven further to exit from an outlet.

Preferably the liquid is drawn into the rotating head from a sump, and then collected and returned to the sump after being discharged from the rotating head, and further preferably the gas is drawn into the housing by the liquid movement, and enters the housing to contact the discharging liquid substantially normally to the radial liquid flow.

The gas may be drawn into the housing axially along a tubular gas inlet leading to the discharging liquid, which is discharged radially from the centre region of the end of the gas inlet.

There is provided for the head to be rotated by a source of motive power located centrally within the tubular gas inlet.

Further features of the invention provide for the gas to be driven out through an annular gas outlet displaced around the tubular gas inlet, for the gas to be drawn downwardly in the inlet and to exit generally upwardly from the annular gas outlet, and for the liquid to be collected through an annular passageway loading downwardly from an annular entrance dispersed around the annular gas outlet, to the sump.

There is also provided for the liquid to be discharged from the head through outlets which are axially staggered relative to the rotational axis of the head, the liquid to be discharged from tubular outlets extending radially from the head, and for the liquid to be discharged from a plurality of outlet holes at the end of each tubular outlet.

The gas may be air, and the liquid water, in which case the air is scrubbed, humdified or cooled by contact with the dispersed and discharged water. The water can also be cooled by contact with the air.

The invention extends to an apparatus for treating a gas or a liquid comprising a housing having a gas outlet, and a gas inlet leading to the periphery of a rotatable head, the head having a liquid inlet and liquid outlet means and being rotatable within the housing to discharge and partially disperse liquid from the head outlet generally radially outwardly from the outlet means, to thereby move in use gas in contact with the discharged and dispersed liquids from the gas inlet to the outlet.

Features of the invention provide for the gas inlet to lead generally normally towards the radial discharge path of the liquid from the head, for gas inlet to be tubular and to lead gas to the whole of the periphery of the head located centrally within the inlet at the bottom thereof.

A motor can be connected to drive the head rotationally and is located centrally within the inlet wall.

Preferably the gas inlet leads towards the head in an operatively downwards direction, and the gas outlet is annular and located around the gas inlet, to have an outlet which faces upwardly in use.

Further preferably the head has an opening in its operatively bottommost end which forms its liquid inlet, and is located in a liquid sump at the bottom of the housing.

The liquid return passage way can lead from an annular entrance around the gas outlet, downwardly to the sump.

There is also provided for the liquid discharge outlets to be in the form of apertures located at the free ends of tubes radially extending from, and spaced apart about, the rotatable head, and for the radially extending tubes to be arranged in two rows of alternately and axially staggered tubes, each tube end having a plurality of outlet apertures.

BRIEF DESCRIPTION OF THE DRAWINGS

A preferred embodiment of the invention is described below by way of example only, and with reference to the accompanying drawing in which.

DETAILED DESCRIPTION OF THE DRAWINGS

Figure 1:
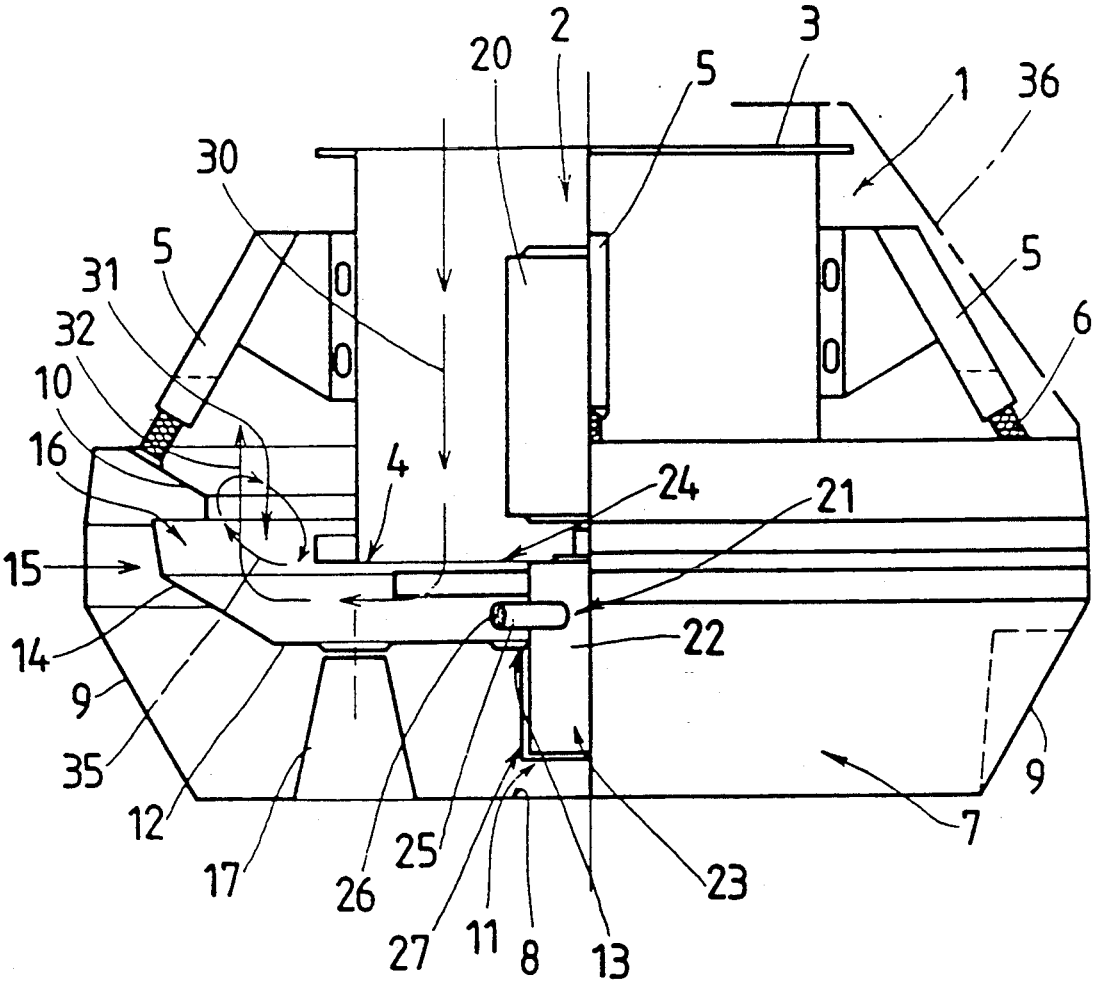
FIG. 1: is a side view of apparatus operated in accordance with the method of the invention shown with one axial half in cross-section; and, FIGS. 2 and 3: are a side and top view respectively of a rotating head used in the embodiment of FIG. 1.

Referring to FIG. 1, an apparatus 1 is provided for treating a liquid or a gas, which in this embodiment is water and air. The apparatus comprises an inlet passage way 2 formed by a large squat tubular air intake, having an operatively upper end 3 and a operatively lower end 4. The air intake has radially extending support legs 5 spaced apart on the outer circumference, which allow the intake to rest, through suspension means 6, on a further housing member indicated generally by numeral 7.

The further housing member is in the form of a broad flat tub, and the upper part of it receives the air intake concentrically on top of it. The housing 7 has a bottom 8 with an upwardly extending circumferential side 9, which is turned over at the top to form an downwardly tapering annular skirt 10. The inner skirt circumference is spaced apart from the intake to leave an annular space there between which defines an air outlet. The legs 5 of the intake rest on the upper surface of the skirt.

A sump chamber 11 is formed between the bottom 8 of the housing member 7, and a spaced apart annular wall 12 set above the bottom. The central opening 13 in the annular wall is concentric with the housing member 7, and the wall has a circumferential side 14 which extends upwardly spaced apart from the side 9. Both the circumferential sides 9 and 14 taper outwardly from their respective centres, but their tapers are convergent to leave an upwardly converging annular passageway 15 between the two sides. The side 14 extends to be on the same operatively horizontal level with the inner periphery of the skirt 10, and is spaced apart therefrom to create an annular opening 16 which leads into the annular passage 15 down into the sump chamber 11.

The wall 12 is supported in this position on legs 17 resting on the bottom 8. The legs are spaced from each other on a pitch circle about the centre axis of the housing member 7.

Located centrally within the inlet 2 is an electric motor 20, supported therein by radial struts (not shown). The motor has its shaft facing downwardly and connected to drive a rotatable head 21, which is formed by a tubular hub 22 extending down into the sump chamber and having an open bottom 23 in the sump chamber.

Figure 2:
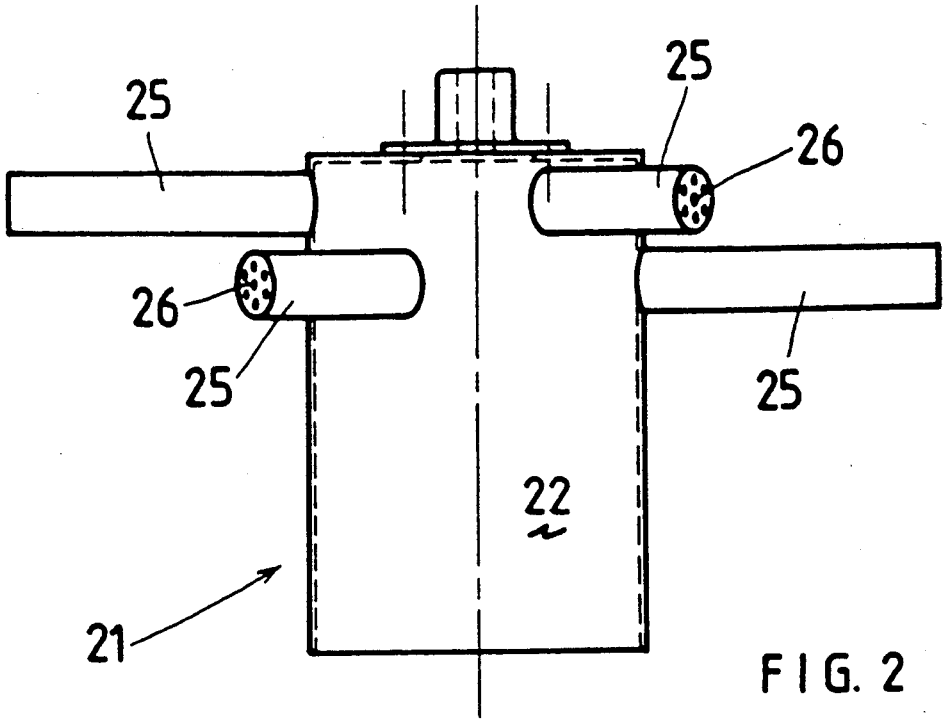
Figure 3:
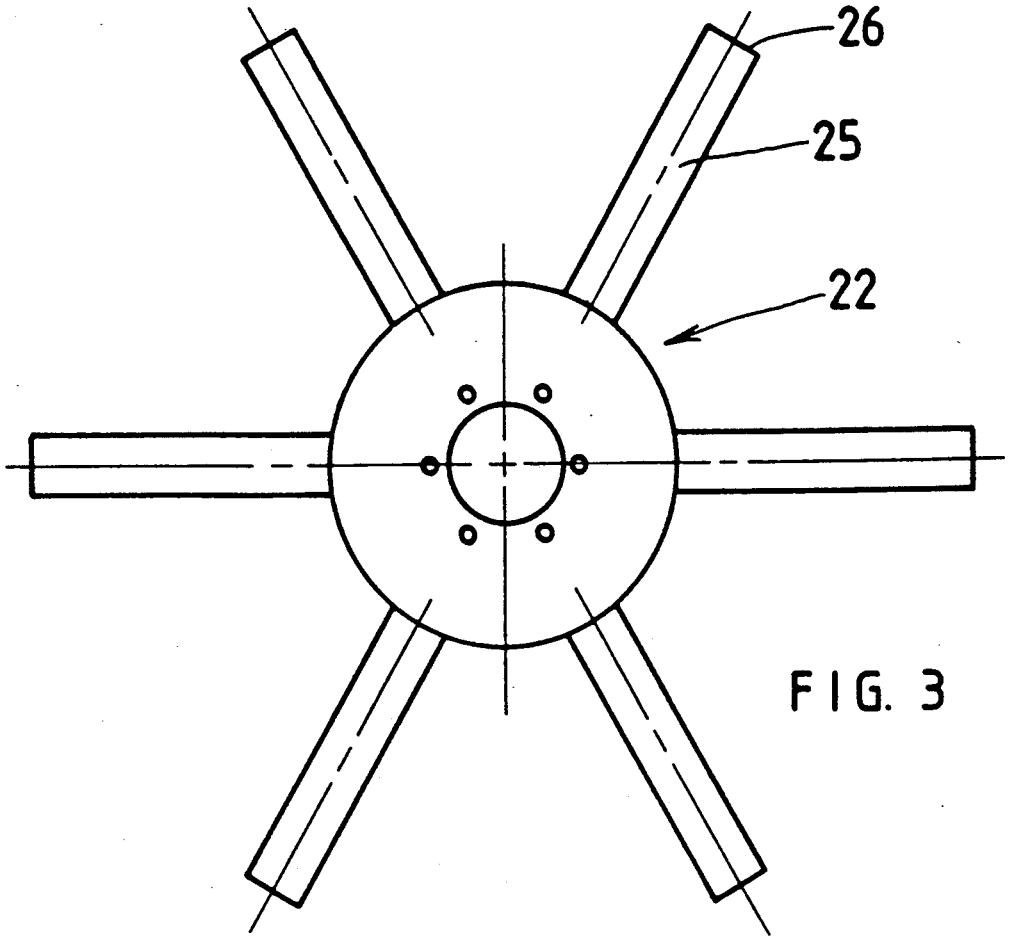

The head shown also in FIGS. 2 and 3 closely fits within the central opening 13 in the wall 14, and has radial liquid outlets 24 below the end of the inlet 2 at its upper section above the wall 12, below the end of the inlet 2. These outlets are formed by tubes 25 extending radially outwardly from the hub. The free ends 26 of the tubes have a plurality of holes spaced apart in them forming liquid outlet nozzles. These tube ends stop short of the wall of the inlet 2, and are located just below it. There are six tubes, each staggered axially from each other in the length of the hub, to form two rows of three tubes. The hub is located within a depending sleeve 27 secured by a flange to the periphery of the wall opening 13, to form an hydraulic seal between sleeve and hub in use.

In use, the sump chamber 17 is primed with water, and the electric motor is used to drive the head in a rotatable manner. The water within the head is thrown outwardly by centrifugal force and rises in the head to be discharged from the outlet tubes 24 and the nozzles 26. The water thus flows outwardly to form a spiral in plan view as each droplet exits and travels radially towards the inside of the side 14 of the wall 12.

The movement of the water being flung out radially urges air to follow the same path, and air is drawn along the inlet passed the motor 20, as indicated by numeral 30, out through the air exit opening 31 formed by the space between the skirt 10 and the inlet 2. This is shown by arrow 32. The water itself enters the passageway 15 through the inlet 16 and flows back to the sump.

The effect of the driving of the air in contact with the dispersed water, is to cause scrubbing and cooling of the air, as well as humidifying of the air. The air driven out of the exit 31 has been treated and is suitable for use in ventilation systems. It has been found in practice that the air is particularly suitable for air ventilation in industrial environments.

An additional effect which takes place at the air exit is the swirling of water which does not pass immediately into the exit opening 16. This water moves at high velocity in a oval pattern, indicated by numeral 35 in FIG. 1. The swirl movement is in a radial plane and extends around the annular gas exit space. Since the exiting air passes through this water, a thorough scrubbing effect is obtained.

A cowling shown partly and in dashed lines 36, is provided in sealed manner over the housing member 7 and around the inlet 2, to receive air from outlet 31 and pass it through an offtake duct from the cowling.

The water is also cooled by evaporative effect and is returned to the sump considerably cooled.

The apparatus and method can be used to move fairly large volumes of air required for ventilation, and if necessary an additional booster fan may be used at the entrance to the air intake to further move air through the system, if the air is to be moved through ducting.

It has been found that power required to move a specific volume of water with this apparatus is less than if a conventional centrifugal pump were to be used. A motor of some 1 kw can displace approximately 30 liters per second of water, thereby driving an air volume of two to three $m^3$ per second of air.

The length of the tube, given a constant rotational velocity of the head, determines the exit velocity of water which is proportional to the velocity with which the air is driven. A water velocity of 30 m/s provides an air velocity of some 10 m/s.

It is considered that the invention provides a simple and effective method and apparatus for the treating of air in particular, but the principal can be applied to other gases and liquids.

What I claim as now and desire to secure by Letters Patent is:

1. A method of treating a gas or a liquid comprising introducing a liquid into a rotating head having a liquid outlet means around it, rotating the head in a housing to discharge the liquid generally radially outwardly from the head towards the housing wall and to cause the liquid to be partially dispersed, and by movement of the discharged liquid, drawing a gas into the housing axially along a tubular gas inlet so as to be in contact with the dispersed and discharged liquid substantially normal to the radial liquid flow, to thereby cause at least one of the liquid or gas to be treated, the gas being driven further radially by the discharged liquid to exit from an outlet, the liquid being drawn into the rotating head from a sump, and then collected and returned to the sump after being discharged from the rotating head, the liquid also being discharged from the head through outlets which are axially staggered relative to the rotational axis of the head, the liquid being discharged from tubular outlets extending radially from the head.

2. A method as claimed in claim 1 in which the liquid is discharged from a plurality of outlet holes at the end of each tubular outlet.

3. A method of treating a gas or a liquid comprising introducing a liquid into a rotating head having a liquid outlet means around it, rotating the head in a housing to discharge the liquid generally radially outwardly from the head towards the housing wall and to cause the liquid to be partially dispersed, and by movement of the discharged liquid, drawing a gas into the housing axially along a tubular gas inlet so as to be in contact with the dispersed and discharged liquid substantially normal to the radial liquid flow, to thereby cause at least one of the liquid or gas to be treated, the gas being driven further radially by the discharged liquid to exit from an outlet, the liquid being drawn into the rotating head from a sump, and then collected and returned to the sump after being discharged from the rotating head, the gas being driven out through an annular gas outlet displaced around the tubular gas inlet, the gas also being drawn downwardly in the inlet and exiting generally upwardly from the annular gas outlet, the liquid being collected through an annular passageway leading downwardly from an annular entrance dispersed around the annular gas outlet to the sump, the discharged liquid at the housing wall being directed slightly upwardly to pass in communication with but underneath the gas outlet and cause a swirling pattern of liquid movement in a radial plane, around the circumference of the annular gas outlet, through which liquid movement the exiting gas is driven.

4. An apparatus for treating a gas or a liquid comprising a housing having a gas outlet, a rotatable head having a periphery, a liquid inlet and a liquid outlet means and being rotatable within the housing to discharge and partially disperse liquid from the head outlet generally radially outwardly from the outlet means, and a tubular gas inlet leading axially to the periphery of the rotatable head, said discharged liquid providing the force to thereby move said gas in contact with the discharged and dispersed liquid substantially normal to the radial liquid from the gas inlet to the gas outlet, the liquid discharge outlets being in the form of apertures located at the free ends of tubes radially extending from, and spaced apart about, the rotatable head, the radially extending tubes being arranged in two rows of alternately and axially staggered tubes.

5. An apparatus for treating a gas or a liquid comprising a housing having a gas outlet, a rotable head having a periphery, a liquid inlet and a liquid outlet means and being rotatable within the housing to discharge and partially disperse liquid from the head outlet generally radially outwardly from the outlet means, and a tubular gas inlet leading axially to the periphery of the rotatable head, said discharged liquid providing the force to thereby move said gas in contact with the discharged and dispersed liquid substantially normal to the radial liquid from the gas inlet to the gas outlet, the liquid discharge outlets being in the form of apertures located at the free ends of tubes radially extending from, and spaced apart about, the rotatable head, each tube end having a plurality of outlet apertures.

* * * * *